US005218154A

United States Patent [19]

Kondo

[11] Patent Number: 5,218,154

[45] Date of Patent: Jun. 8, 1993

[54] ELECTRONIC KEYBOARD INSTRUMENT WITH AN UNIQUE TONE CHANNEL ASSIGNOR FOR PERCUSSION TONES

[75] Inventor: Yoichi Kondo, Saitama, Japan

[73] Assignee: Kabushiki Kaisha Kawai Gakki Seisakusho, Shijuoka, Japan

[21] Appl. No.: 903,759

[22] Filed: Jun. 25, 1992

[30] Foreign Application Priority Data

Jun. 27, 1991 [JP] Japan ..... 3-183000

[51] Int. Cl.[5] ..... G10H 1/057; G10H 1/22; G10H 5/00

[52] U.S. Cl. ..... 84/618; 84/627; 84/DIG. 2

[58] Field of Search ..... 84/618, 627, DIG. 2

[56] References Cited

U.S. PATENT DOCUMENTS 5,095,800 3/1992 Matsuda ..... 84/618

5,159,144 10/1992 Fujisawa et al. ..... 84/DIG. 2

*Primary Examiner*—Stanley J. Witkowski

[57] ABSTRACT

An electronic keyboard instrument having simultaneous tone channels for generating a plurality of kinds of tones such as percussion tones upon a keyboard operation is disclosed. A memory (17b) stores inherent tone duration values of different kinds of tones to be generated in correspondence with a plurality of keys of a keyboard. A register group (32) for holding tone duration values in correspondence with a plurality of tone channels is arranged. The values held in the register group are decreased by a subtracter (33) along with an elapse of time. Upon a key-ON event, a detector (34) detects the minimum value of the tone duration values held in the register group. A channel corresponding to the register which holds the minimum value is assigned as a new tone channel, and the content of the register is updated with the fixed tone duration value stored in the memory. The updated register renews assignment of a tone channel in a tone source.

4 Claims, 6 Drawing Sheets

(PRIOR ART)
(KEY-ON)
(DRUM TONE)
(CHAN ASSIGN.)
(GATE TIME)
(CHAN ASSIGN.)

ELECTRONIC KEYBOARD INSTRUMENT WITH AN UNIQUE TONE CHANNEL ASSIGNOR FOR PERCUSSION TONES

BACKGROUND OF THE INVENTION

1. Field of the Invention

The present invention relates to a tone channel assignment apparatus for, e.g., an electronic keyboard instrument and, more particularly, to an apparatus suitably used in an electronic musical instrument for generating percussion tones such as drum tones according to key operations.

2. Description of the Related Art

In electronic keyboard instruments such as an electronic piano, an electronic organ, and the like, tone source data stored in a PCM waveform memory is read out according to a tone color and key data, and is output as a tone generation signal after its amplitude, envelope, and the like are processed. In order to generate tones corresponding to some simultaneously depressed keys or to generate accompaniment tones, a tone generator has a plurality of simultaneous tone channels.

A channel assignor manages tone channels, and assigns a tone to be generated in response to a key-ON event to an empty channel or a channel having a low priority order.

As a key assign method of the assignor, a first-depression priority method or a last-depression priority method is known. Also, the following method is known. In this method, when there is no empty channel, the envelopes of assigned tone waveforms are compared, and a new key is assigned to a tone channel having the lowest envelope level, i.e., a channel closer to the end of tone generation (envelope minimum value detection method).

An electronic keyboard which has the following play mode is known. In this play mode, instrument tones of a rhythm (percussion) section including drums, cymbals, and the like are assigned to some keys at, e.g., the left end side of a keyboard, so that a rhythm accompaniment play can be performed with the left hand simultaneously with a melody play with the right hand. In this mode, the keys of the rhythm section are also controlled under the channel assignment management of the above-mentioned assignor.

The assignor is generally constituted by a microprocessor and a program. The program executes real-time processing, and consists of a large number of steps. Thus, an expensive, high-speed microprocessor is required.

In an assignor which responds to only an ON/OFF event of a key, i.e., which operates independently of envelope levels, when there is no empty channel, unnatural channel assignment occurs inevitably. On the other hand, an assignor based on the envelope minimum value detection method requires a complicated arrangement and processing sequence although unnatural channel assignment can be eliminated.

SUMMARY OF THE INVENTION

It is an object of the present invention to simplify an assign method for rhythm section tones such as drum tones to simplify the arrangement and processing of the overall assignor, so that high-speed response characteristics can be realized even by a low-speed microprocessor.

It is another object of the present invention to minimize generation of unnatural tones by a key assign operation (for changing the content of a channel in tone generation) when there is no empty channel.

As shown in FIG. 2, a tone channel assignment apparatus of the present invention comprises a plurality of keys of a keyboard corresponding to a plurality of kinds of tones to be generated, a memory **17*b* for storing inherent tone duration values in units of keys, a register group 32, arranged in correspondence with a plurality of tone channels, for holding tone duration values, a subtraction means 33 for decreasing the values of the registers along with an elapse of time, a detection means 34 for detecting a minimum value of the tone duration values held in the register group, a channel assignment means 31 for reading out the corresponding tone duration value from the memory 17*b* in response to a new key operation (ON event), writing the readout value in a register having the minimum value detected by the detection means, and assigning a channel corresponding to the register as a new tone channel, and a tone generator 19** in which tone source parameters corresponding to the keys are set in units of tone channels according to key operation data and channel assign data based on the contents of the register group.

Tone channels are determined based on only key-ON events, and key-OFF data is not used in management of channels, thus allowing easy channel assign processing. Since channel management is performed using the register group for holding the tone duration values which are decreased along with an elapse of time, the arrangement is simple.

Since the channel assign operation is performed based on minimum value detection of the register group, when all the channels are assigned, a channel which does not cause generation of an unnatural tone even if its tone generation is stopped is updated.

DETAILED DESCRIPTION OF THE PREFERRED EMBODIMENT

Figure 1:
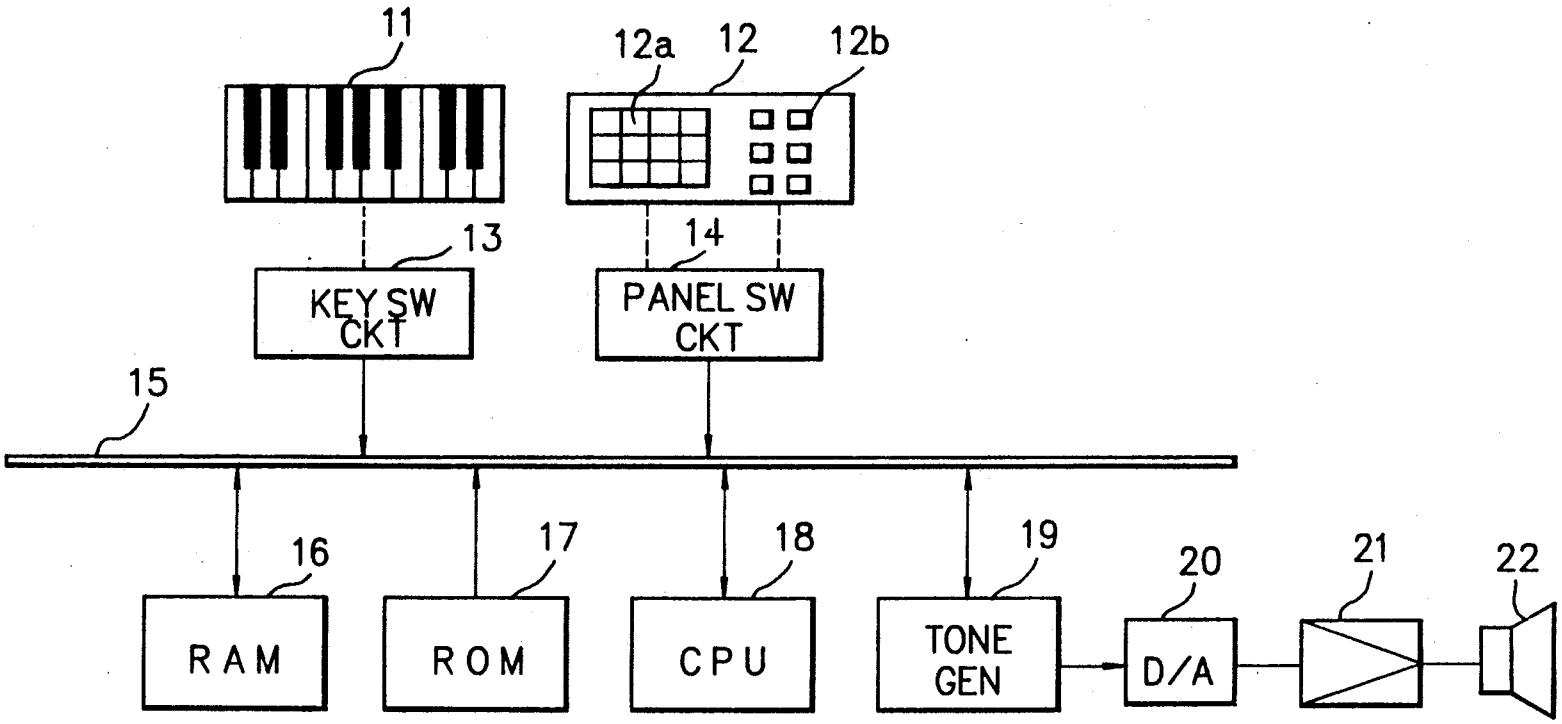
FIG. 1 is a block diagram showing the overall electronic musical instrument according to an embodiment of the present invention.

FIG. 1 is a block diagram showing principal part of an electronic musical instrument according to an embodiment of the present invention. The electronic musical instrument comprises a keyboard 11 and an operation panel 12. The circuit portion of the electronic musical instrument is constituted by a microcomputer consisting of a CPU 18, a ROM 17, and a RAM 16, which are connected to each other through a bus 15.

The CPU 18 supplies note data corresponding to a keyboard operation, and parameter data such as rhythm data, tone color data, and the like corresponding to an operation of a ten-key pad **12*a*, panel switches 12*b*, and the like to a tone generator 19. The tone generator 19 reads out PCM tone source data from a waveform memory of the ROM 17 on the basis of these data, processes the amplitude and envelope of the readout data, and supplies the processed data to a D/A converter 20. A tone signal obtained from the D/A converter 20 is supplied to a loudspeaker 22 through an amplifier 21**.

Figure 2:
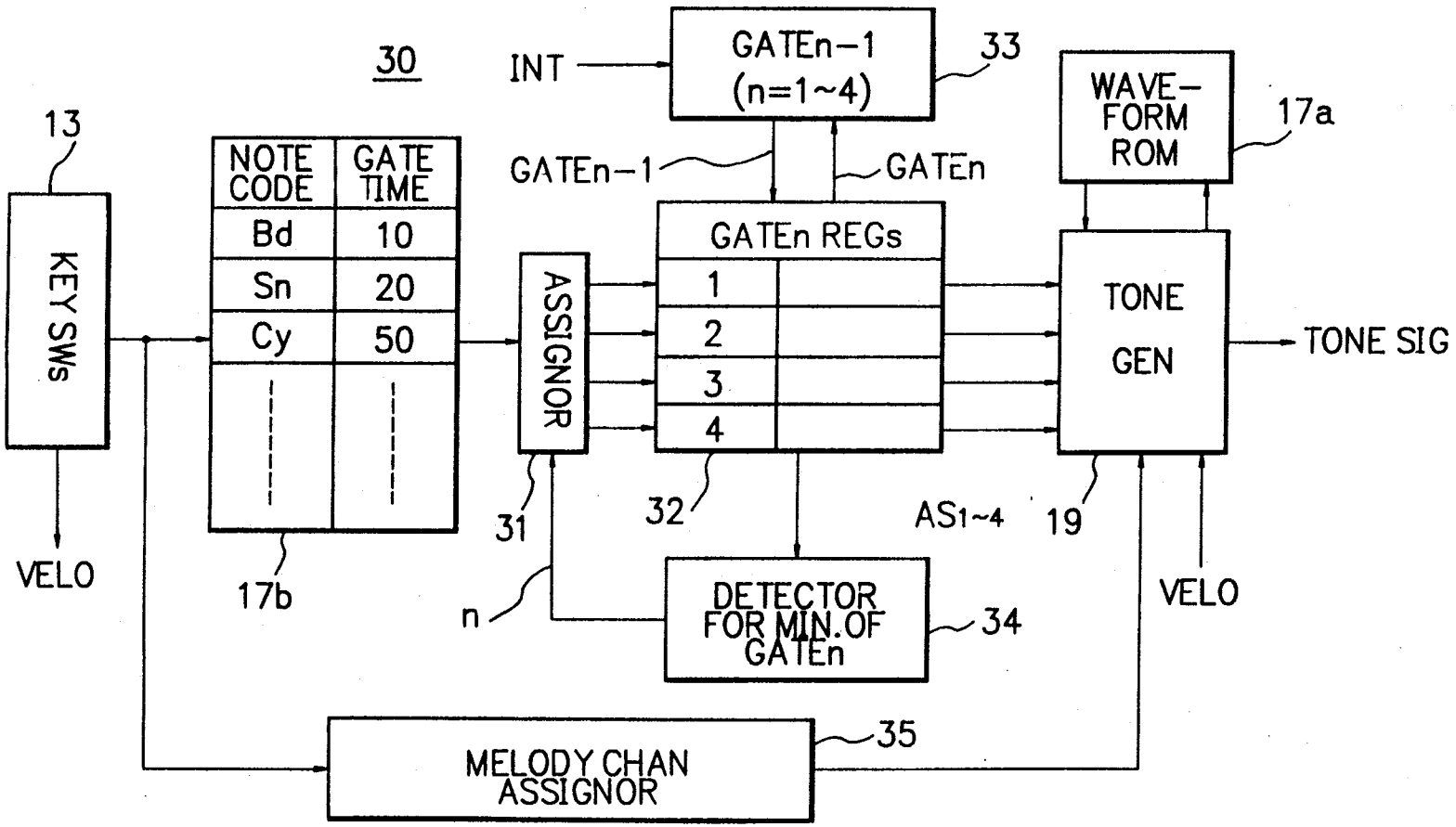
FIG. 2 is a block diagram showing principal constituting members as the characteristic feature of the present invention.

FIG. 2 is a functional block diagram of a channel assignor in the electronic musical instrument shown in FIG. 1, and FIGS. 6A to 6E are waveform charts showing its operation. The functions of the assignor are realized by the CPU 18 (FIG. 1) and a program written in the ROM 17.

As shown in the embodiment of FIG. 2, an assignor 30 exclusively used for rhythm section tones such as drum tones is arranged in addition to a melody channel assignor 35 for a normal melody line. The assignor 30 has, e.g., four (n=4) tone channels, and is constituted by dividing some of existing channels of the melody channel assignor 35 or by adding new four channels.

Figures 6A, 6B, 6C, 6D, 6E:
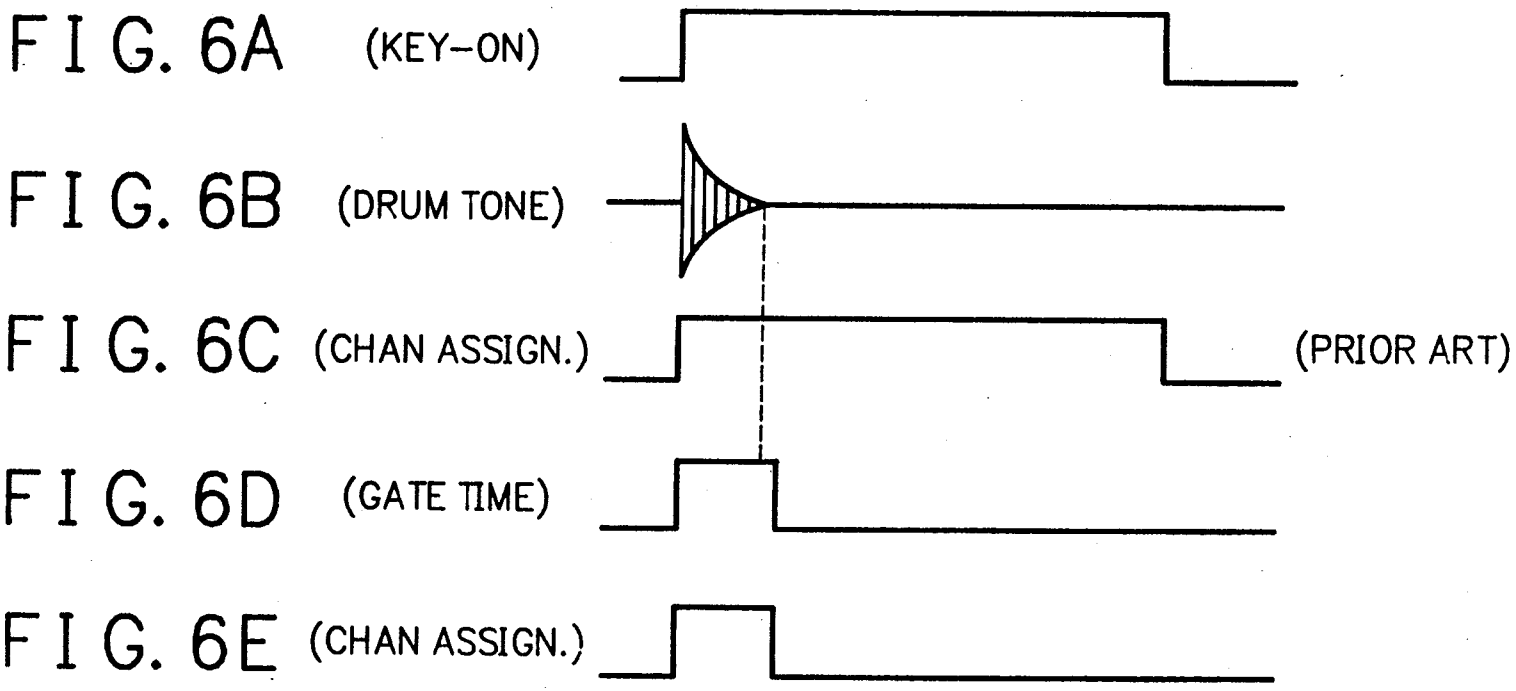
FIGS. 6A to 6E are waveform charts showing tone and channel assign waveforms.

The assignor 30 does not operate in response to both ON and OFF events of a key as input data unlike the melody channel assignor 35, which is the same as the conventional assignor, but operates in response to only key-ON events. Operation parameters of the assignor 30 include note codes (key codes) corresponding to ON keys, and tone durations (gate times) of tone colors such as a drum, cymbal, and the like assigned in units of notes. The gate time normally indicates a time duration between ON and OFF events of a given key (FIG. 6A). In this embodiment, paying attention to the fact that a tone such as a drum tone is generally ended within a relatively short period of time as shown in FIG. 6B assign processing (FIG. 6E) of assigned channels is performed based on a predetermined fixed gate time (FIG. 6D) regardless of key OFF events.

The assignor 30 is mainly constituted by a memory table **17*b* for storing fixed gate times corresponding to note codes, registers 32, corresponding in number to channels, for storing gate times as variable values, a channel assignor 31, a "−1" subtracter 33, and a minimum value detector 34**.

The memory table **17*b* is allocated on the ROM 17 shown in FIG. 1. As shown in FIG. 2, the table 17*b*** stores a gate time (10 msec) of a bass drum (Bd), a gate time (20 msec) of a snare drum (Sn), a gate time (50 msec) of a cymbal (Cy), and the like in correspondence with note codes.

The registers 32 are allocated on the RAM 16. The channel assignor 31, the "−1" subtracter 33, and the minimum value detector 34 correspond to arithmetic processing functions of the CPU 18.

Figure 3:
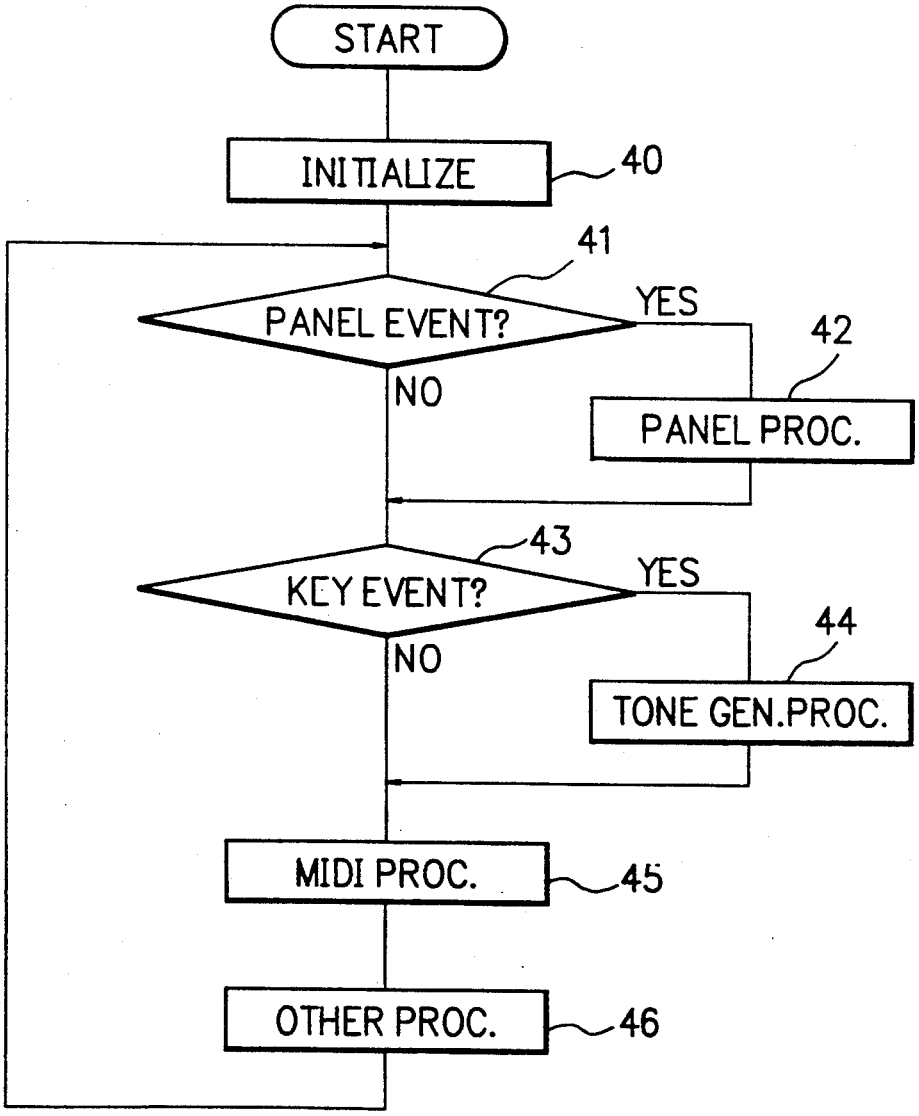
FIG. 3 is a flow chart showing main routine processing by a CPU.
Figure 4:
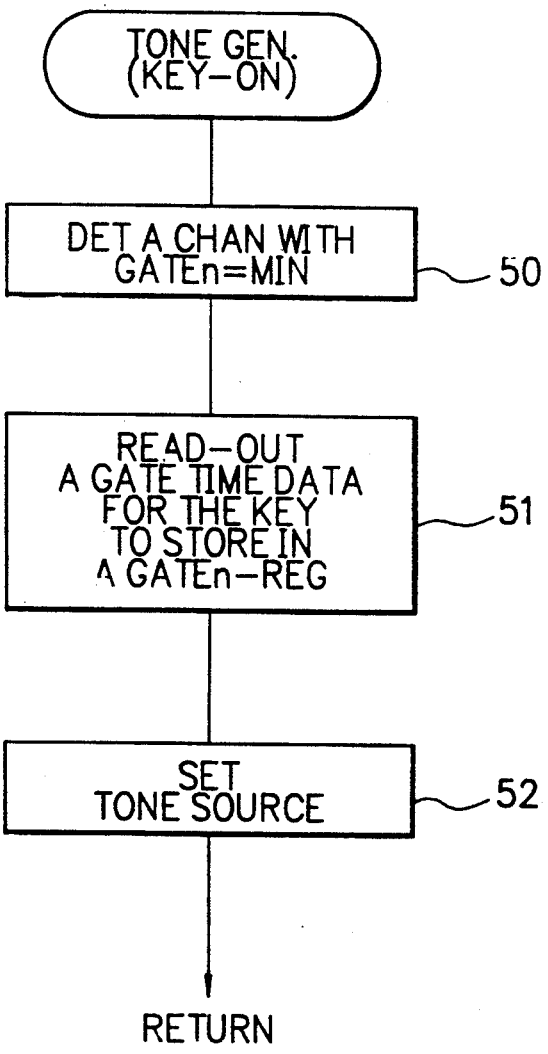
FIG. 4 is a flow chart showing a tone generation processing sequence.
Figure 5:
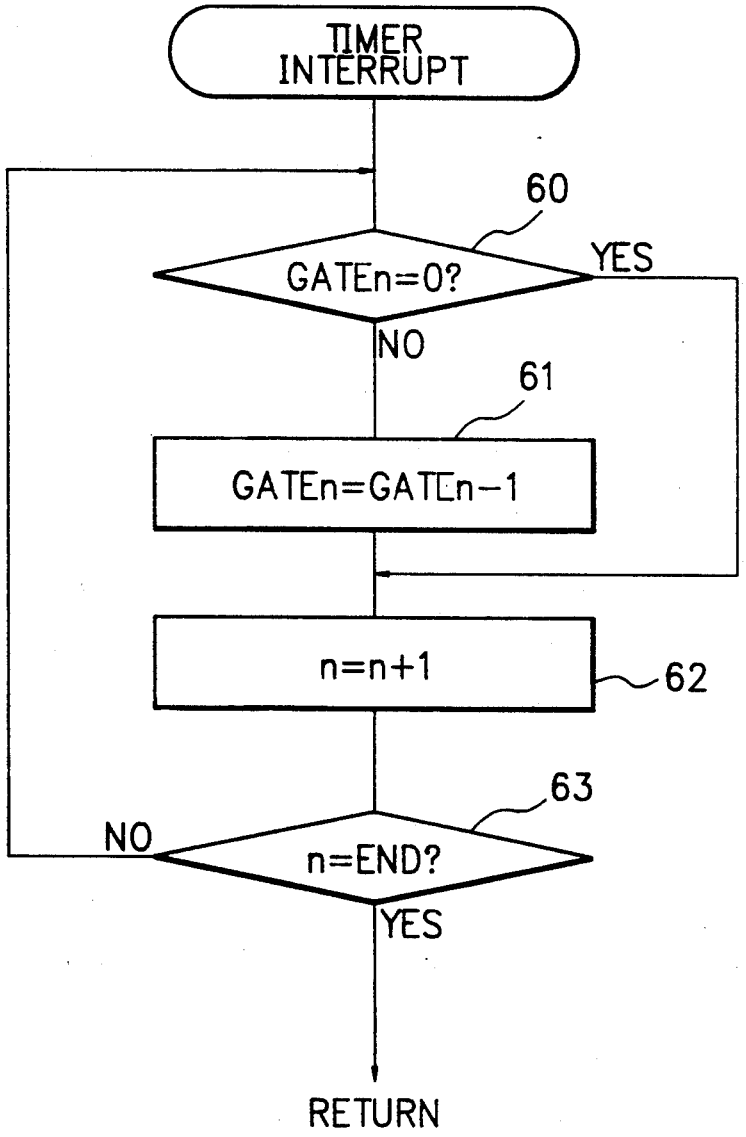
FIG. 5 is a flow chart showing timer interrupt processing.

FIGS. 3 to 5 show the processing sequence of the assignor 30 by the CPU 18. FIG. 3 shows the main routine. In the initialization processing in step 40, the system is initialized, and in step 41, the panel switches are scanned. If an ON switch is detected, panel processing is performed in step 42. In step 43, key switches are scanned. If an ON switch is detected, tone generation processing of the corresponding key is performed in step 44. In step 45, MIDI processing for an auto-play mode is performed. In step 46, other processing operations are performed. This main routine is circulated at a given cycle.

FIG. 4 shows the tone generation processing in step 44 in FIG. 3. In step 50, a minimum value MIN or zero of the values in the registers 32, which hold gate times GATEn (n=1 to 4) for four channels is detected by the minimum value detector 34. If the detected register value is not zero but the minimum value, tone generation stop processing of the corresponding channel is performed. The number of the detected register corresponds to a channel to be assigned. In step 51, the gate time of a note code corresponding to an ON key is read out from the table **17*b*, and is written in a register corresponding to the detected minimum value of the registers 32 by the assignor 31**. Thus, a tone channel corresponding to the key is determined.

In step 52, tone source parameters are set in the tone generator 19, and a tone signal corresponding to the ON key is formed. More specifically, the tone generator 19 receives channel assign data AS formed based on the contents of the channels of the registers 32, and also receives key ON velocity data VELO and key number data KEY (note code) from a key switch circuit 13. The tone generator 19 reads out a PCM signal and envelope data of, e.g., a drum tone having a tone color assigned to the key number from a waveform memory **17*a* allocated on the ROM 17** on the basis of these data. The readout PCM signal is amplitude-modulated based on the envelope data and the key ON velocity data, and the modulated signal is output as a tone signal for tone generation.

FIG. 5 shows a timer interrupt routine, and shows the processing when the "−1" subtracter 33 in FIG. 2 is enabled at an interrupt signal INT generated by the CPU 18 at a predetermined time interval. In step 60, it is checked if the value GATEn (n=1) of the registers 32 is zero. If NO in step 60, a subtraction GATEn−1 is executed in step 61. Then, the channel number n is incremented by +1 (step 62), and "−1" subtraction processing of the registers is performed until n=END (end of all the channels) is determined in step 63. More specifically, the gate times in the registers are decreased by "−1" at the predetermined time interval. Note that the CPU 18 generates channel assign data AS1 to AS4 (FIG. 6E) until the contents of the registers 32 become zero.

Note that the channel assign data is used for setting (assign ON) or clearing (assign OFF) parameters in the corresponding channel of the tone generator 19. As shown in FIG. 6B, when tone source parameters corresponding to a key are set, and tone generation is executed, the tone is automatically stopped according to a waveform envelope regardless of a key OFF event. Therefore, the gate times stored in the table **17*b*** are set to be slightly longer than the time durations of envelope waveforms of percussion tones stored in advance in correspondence with musical instruments such as drums.

As described above, in this embodiment, fixed gate times corresponding to keys are set in advance, and are written in the registers, so that the register values are decreased along with an elapse of time. The minimum value of the registers corresponding in number to the channels is detected, and a new key is assigned to a channel corresponding to the minimum value.

Therefore, a new key is normally assigned to a channel which is not subjected to tone generation, and when all the channels are assigned, a new key is assigned to a channel, which is expected to end tone generation earliest. For this reason, natural channel assignment similar to the above-mentioned envelope minimum value detection can be performed.

Since the channel assign algorithm is very simple, i.e., since the minimum value of the registers corresponding in number to channels is detected, the number of processing steps is small, and high-speed response characteristics can be realized. Therefore, the arrangement of the assignor can be simplified, and an inexpensive, low-speed microprocessor can be used.

As described above, a tone channel is determined based on only key ON data, and tone channels are managed by a register group, which holds tone duration data, whose values are decreased along with an elapse of time. Thus, the processing and arrangement of the channel assignor can be simplified, and high-speed response characteristics can be realized even when an inexpensive, low-speed microprocessor is used.

Since the channel assign operation is performed based on minimum value detection of the register group, even when all the channels are assigned (in tone generation), a channel, which does not cause generation of an unnatural tone even when tone generation is stopped, is updated. Therefore, inconveniences hardly occur in a play operation although the channel assign operation is simple.

What is claimed is:

1. A tone channel assignment apparatus for an electronic musical instrument, comprising:

a plurality of keys on a keyboard corresponding to a plurality of kinds of tones to be generated;

a memory for storing inherent tone duration values in correspondence with the keys;

a register group, arranged in correspondence with a plurality of tone channels, for holding tone duration values;

subtraction means for decreasing the values of the registers along with an elapse of time;

detection means for detecting a minimum value of the tone duration values held in said register group;

channel assignor means for reading out the corresponding tone duration value from said memory in response to a new key operation (ON event), writing the readout value in a register having the minimum value detected by said detection means, and assigning a channel corresponding to the register as a new tone channel; and a tone generator in which tone source parameters corresponding to the keys are set in units of tone channels according to the key operation data and channel assign data based on the contents of said register group.

2. An apparatus according to claim 1, wherein the plurality of kinds of tones are percussion tones such as drum tones, and keys corresponding to the percussion tones are assigned to some keys of the keyboard.

3. An apparatus according to claim 1, wherein said subtraction means comprises a subtracter for decreasing a predetermined value from the contents of the registers at a predetermined time interval.

4. An apparatus according to claim 2, further comprising:

a first assignor for setting tone channels on the basis of ON and OFF events of a key; and a second assignor, comprising an arrangement of claim 1, for setting tone channels on the basis of only ON events of keys, and wherein said second assignor processes percussion section tones such as drum tones.

* * * * *